United States Patent [19]

Kristapovich et al.

[11] 4,202,436

[45] May 13, 1980

[54] APPARATUS FOR HANDLING A PLURALITY OF ARTICLES

[75] Inventors: Paul J. Kristapovich; Ronald M. Schiltz, both of Lake Mills, Wis.

[73] Assignee: Crepaco, Inc., Lake Mills, Wis.

[21] Appl. No.: 9,356

[22] Filed: Feb. 5, 1979

[51] Int. Cl.[2] ..... B65G 37/00

[52] U.S. Cl. ..... 198/472; 198/580

[58] Field of Search ..... 62/380, 382; 198/648, 198/580, 795, 472, 473

[56] References Cited

U.S. PATENT DOCUMENTS

| | | | |
|---|---|---|---|
| 3,258,103 | 6/1966 | Bontempi | 198/473 |
| 3,677,393 | 7/1972 | Temple | 198/580 |
| 3,763,991 | 10/1973 | Batik | 198/580 |
| 3,844,428 | 10/1974 | Olsen | 198/472 |
| 3,993,189 | 11/1976 | Khoylian et al. | 198/472 |

*Primary Examiner*—Robert B. Reeves
*Assistant Examiner*—B. Bond
*Attorney, Agent, or Firm*—Neuman, Williams, Anderson & Olson

[57] ABSTRACT

An apparatus is provided for use in combination with a supporting surface for handling a plurality of articles segregated into separate groups with each group having the articles thereof arranged in a predetermined pattern. The apparatus includes an upright framework having an infeed section and a discharge section. The sections are adapted to be disposed adjacent spaced peripheral segments of the surface. Each group is successively positioned initially at a station disposed at the infeed section. A plurality of frame elements are movably carried on the framework and are actuated by a first means in a timed sequence so that a frame element is moved into an encompassing relation with a group of articles disposed at the station. The group and encompassing frame element are moved as a unit by a second means from the station across the surface to the discharge section. Upon reaching the discharge section the group and frame element become separated from one another with the group and associated frame element moving onto separate divergent planes. The separated frame element is returned to the station of the infeed section wherein the first means causes the returned frame element to encompass another group of articles disposed at the station.

16 Claims, 10 Drawing Figures

FIG. 2A
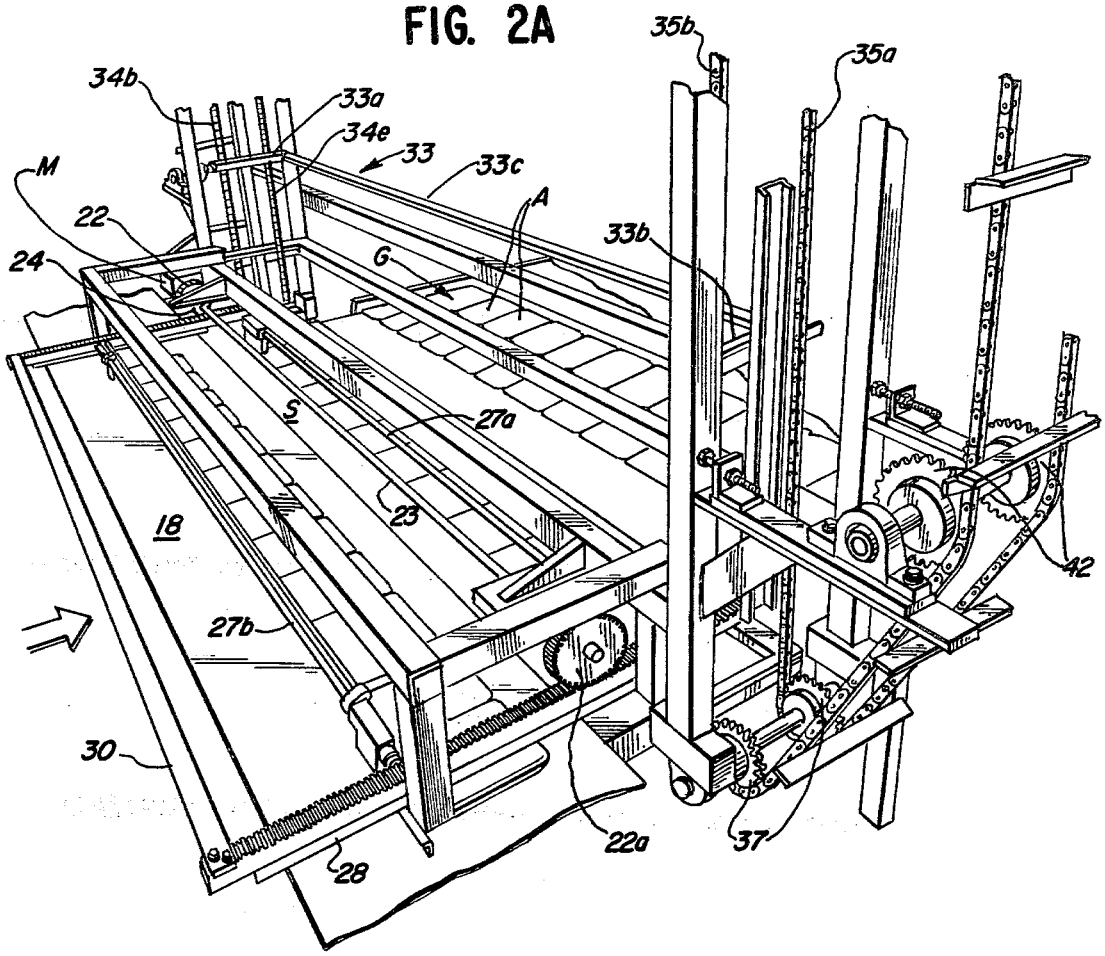
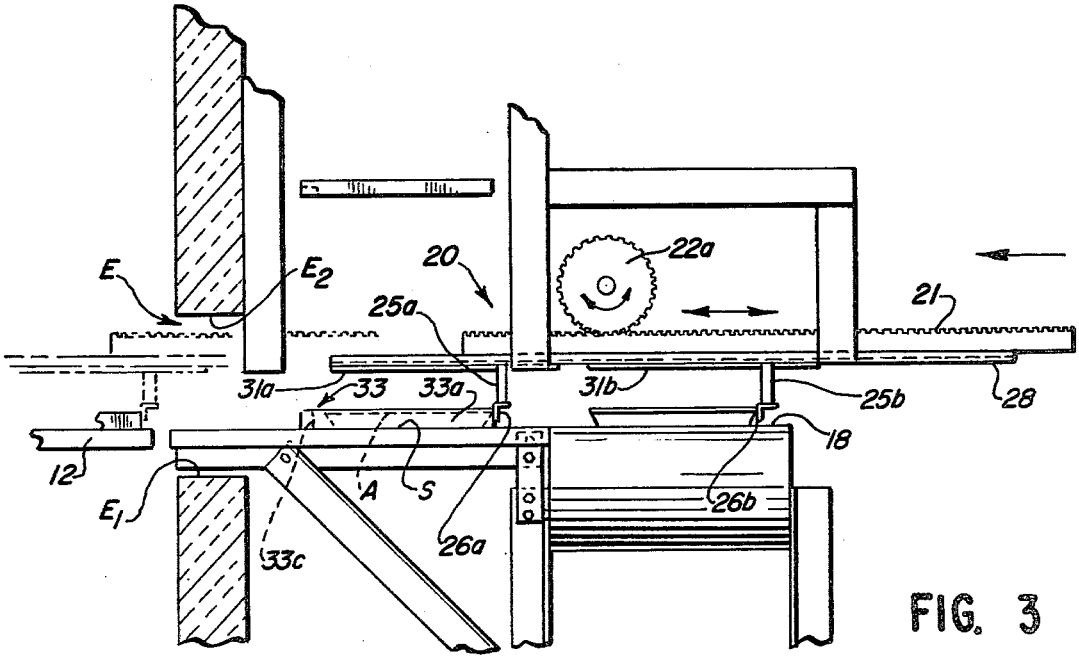
FIG. 3

FIG. 4
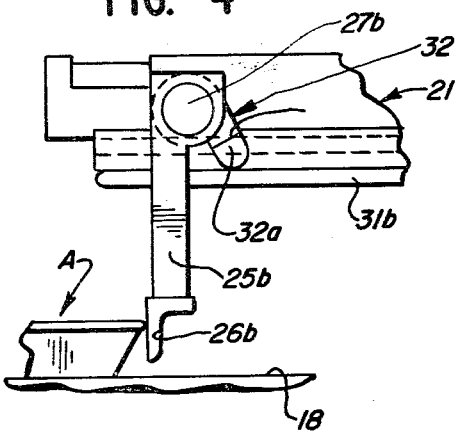
FIG. 5
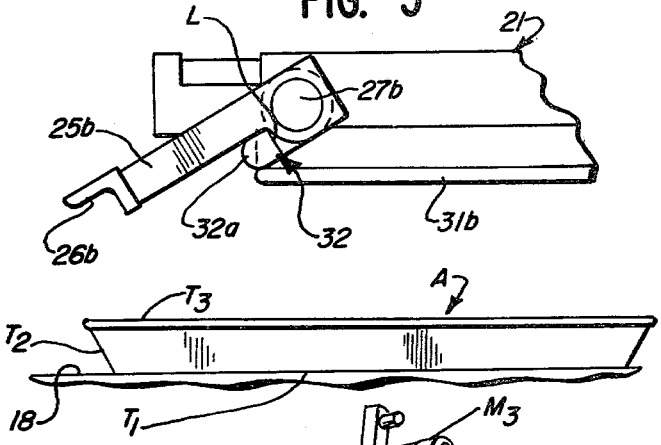
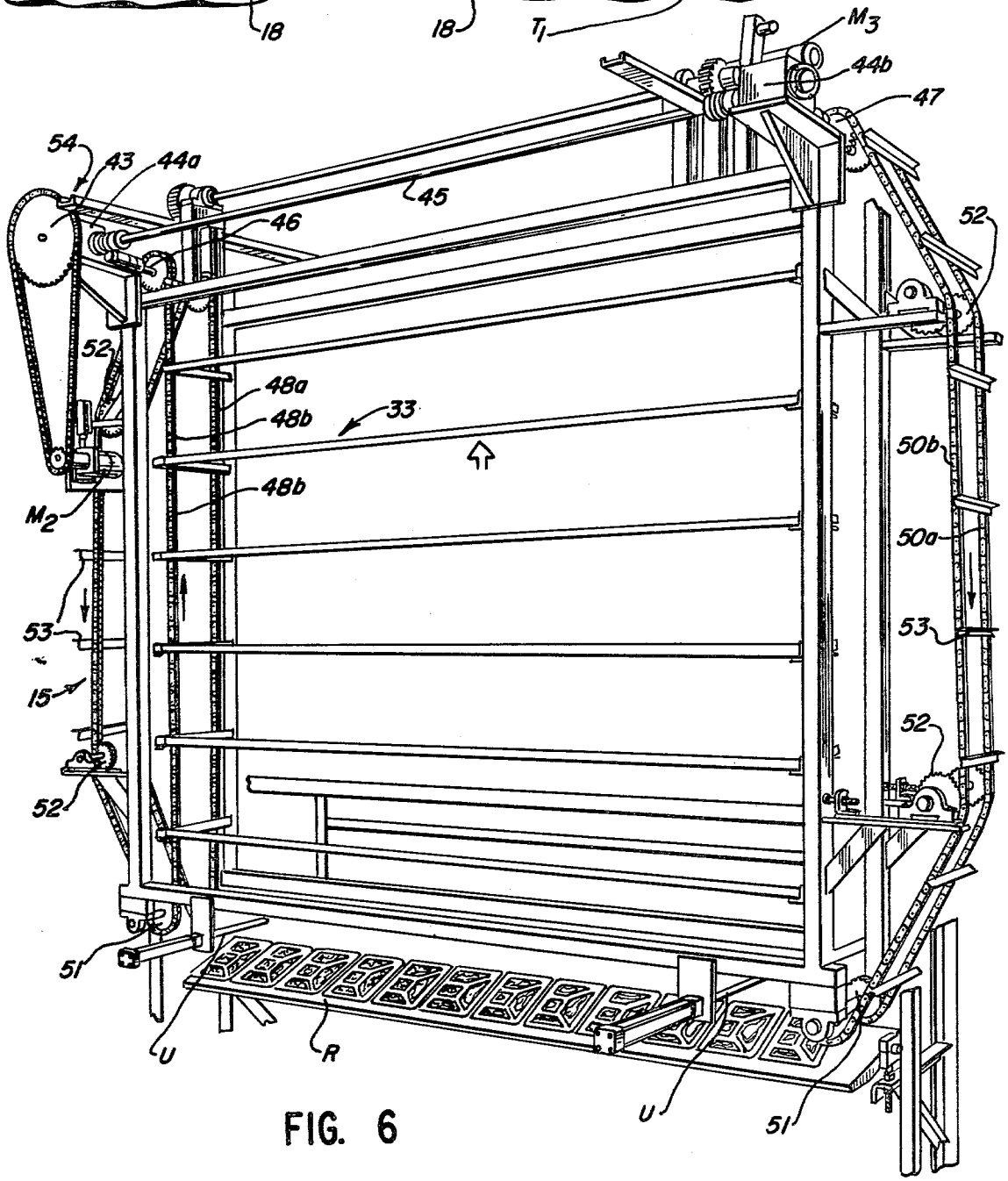
FIG. 6

APPARATUS FOR HANDLING A PLURALITY OF ARTICLES

BACKGROUND OF THE INVENTION

In commercial freezer plants where a large volume of packaged or semi-packaged articles containing portioned quantities of food items or the like are being handled, it is important that the articles be handled as expeditiously as possible prior to and during the article freezing operation without causing spilling of the contents of the article, or defacing of the article itself so as to render same unmerchantable. Many commercial freezer plants utilize various well known plate freezers when carrying out the freezing operation. While such freezers are frequently rather massive in size, they nevertheless in many instances are deemed the most efficient type of apparatus for this purpose and normally require a minimal amount of service and maintenance. The conventional plate freezer includes a plurality of vertically spaced, substantially superposed refrigerated plates between which a plurality of the articles are caused to be moved and subsequently become frozen. Normally, while the articles are being moved into position between the plates they are caused to abut one another so that ultimately the largest number of articles will be accommodated between a pair of plates.

In many instances, the articles to be frozen include disposable trays of thin gauge metal or some other suitable material in which portioned quantities or servings of the food item are disposed. The top of each tray is either open or covered while passing between the freezer plates. The side walls of the tray generally diverge upwardly from the bottom and terminate in a laterally extending ledge which delimits an open top. When such trays are moving across the freezer plate only the upper ledges of the adjacent trays would abut one another. If one attempts to move the articles in such a manner during the plate loading operation and prior to the contents of the trays becoming frozen, one or more of the abutting trays would frequently slide or ride partially over the upper ledge of an adjacent article resulting in tilting and/or distortion of one or both of the articles causing spillage of the contents thereof. When such spillage occurs it is necessary to shut down the equipment for thorough cleaning in order to comply with rigid sanitary restrictions imposed on this type of food handling. In other situations where the articles were of odd size and shape and the movement thereof was not properly controlled, jamming of the articles within the plate freezer was a frequent occurrence again necessitating shutdown of the equipment.

Various apparatus have heretofore been proposed in an attempt to remedy such problems. Primarily, such problems have led to the practice of pre-boxing of irregular or odd-shaped articles prior to freezing to provide more uniform abuttment surfaces. However, because of certain inherent design characteristics such prior apparatus have been beset with one or more of the following shortcomings: (a) the designed capacity of the plate freezer was significantly reduced because of the relatively small number of articles which could be simultaneously handled by the apparatus; (b) individual handling of each article was required thereby complicating the procedure followed in the freezing operation; (c) a variety of odd size and shape articles could not be readily accommodated without substantial modifications being made to various components of the apparatus and the plate freezer; (d) the apparatus was of costly, complex construction and highly susceptible to malfunction; (e) it was difficult to attain controlled handling of the articles and thus effect uniform freezing of the contents of the articles; (f) the apparatus could not be readily installed on or made compatible with existing freezer equipment without substantial modification of the latter, and (g) pre-boxing added to the insulation of the product from the freezer plates.

SUMMARY OF THE INVENTION

Thus, it is an object of the invention to provide an improved article-handling apparatus which readily avoids the aforenoted problems.

It is a further object of the invention to provide an improved article-handling apparatus which markedly enhances the capabilities of a conventional plate freezer.

It is a further object of the invention to provide an improved article-handling apparatus which is capable of being utilized with various types of plate freezers.

It is a still further object of the invention to provide an improved article-handling apparatus which does not interfere with or inhibit the normal operation of a conventional plate freezer.

Further and additional objects will appear from the description, accompanying drawings and appended claims.

In accordance with one embodiment of the invention an apparatus is provided for use in combination with a supporting surface for handling a plurality of articles which have been segregated into groups, each group having the articles thereof arranged in a predetermined pattern. The apparatus includes an upright framework having an infeed section and a discharge section; said sections being disposed adjacent spaced peripheral segments of the surface. Groups of articles are successively positioned in a timed sequence at a station provided at the infeed section. A plurality of frame elements are movably carried on the framework and each element is adapted to be successively moved to an encompassing position with a group of articles previously disposed at the station. Means is provided for intermittently moving simultaneously the assembled frame element and group of articles from the station onto the adjacent surface. After a predetermined time interval the group and encompassing frame element are moved along the surface to the discharge section whereupon the group of articles and encompassing frame element become separated from one another by moving in separate divergent planes. Once the frame element has been separated from the group, it is returned to an encompassing position with respect to a subsequent group of articles located at the infeed station. This will provide a continuous infeeding-discharge system while at the same time recovering the frame elements for recycle usage.

DESCRIPTION

For a more complete understanding of the invention reference should be made to the drawings wherein:

FIG. 1 is a perspective top view of one form of the improved apparatus shown in combination with a conventional plate freezer with portions of the apparatus and plate freezer removed so as to expose one of the plates of the latter which is aligned with the infeed and discharge sections of the apparatus framework and with assembled groups of articles and their encompassing frame elements positioned on the plate surface.

FIG. 2A is an enlarged perspective view of the lower portion of the infeed section of the apparatus shown in FIG. 2.

FIG. 3 is a fragmentary partial schematic side elevational view of the infeed section of the apparatus shown in FIG. 2.

FIGS. 4 and 5 are enlarged fragmentary end views of a first pusher assembly for moving a group of articles to the station of the infeed section of the apparatus framework; FIG. 4 showing the pusher assembly in an operative mode for moving a group of articles to the station, and FIG. 5 showing the pusher assembly in an inoperative mode and moving away from the station.

FIG. 6 is a fragmentary perspective view of the discharge end of the apparatus of FIG. 1.

Figure 1:
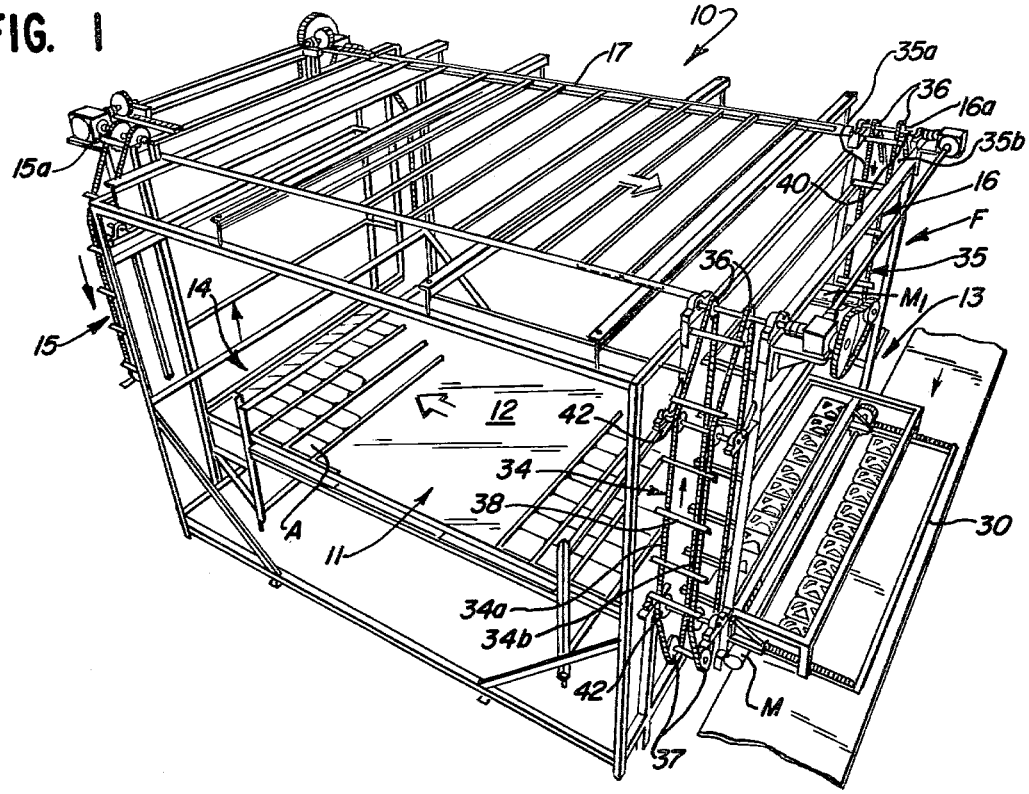

Referring now to the drawings and more particularly to FIG. 1, one form of an improved apparatus 10 is shown which, in the illustrated embodiment, is intended to be utilized in combination with a conventional plate freezer 11. Only one of a plurality of freezer plates 12 is indicated in FIG. 1; notwithstanding that such a freezer customarily embodies a plurality of such plates which are arranged in stacked superpose relation. The plate freezer 11 may be of a type disclosed in U.S. Pat. No. 2,882,697 and widely used in the frozen food industry for freezing a plurality of articles A, each of which contains a predetermined quantity or serving of a food item, or items.

Apparatus 10 includes an upright framework F which is adapted to encompass the exterior of the freezer 11. The framework is provided with an infeed section 13 which is aligned with an entry E provided at one side or end of the plate freezer and through which the articles to be frozen are fed. The framework also includes a discharge section 14, which is spaced horizontally from infeed section 13 and is aligned with an exit, not shown, provided at the opposite side or end of the freezer and through which the articles in a frozen state are discharged.

The freezer, as aforementioned, is provided with a plurality of horizontally disposed rectangular freezer plates 12 which are arranged in stacked superposed relation. Pairs of adjacent freezer plates in vertically spaced relation are successively brought into alignment with the entry and exit of the freezer thereby enabling articles to be positioned between the aligned spaced plates. Once the desired number of articles has been positioned between the aligned plates, the spacing between the aligned adjacent plates is reduced the required amount so that the articles therebetween have the upper and lower surfaces thereof in contact with the adjacent plates. The two plates with the articles therebetween are then raised, or lowered, as a unit relative to the entry and exit thereby causing a second pair of adjacent plates in vertically spaced relation to become aligned therewith. The article-loading process is then repeated until the desired number of plates has been filed. Once this has occurred, each pair of adjacent plates filled with articles is then successively brought into alignment with the freezer exit and entry. The aligned pair of plates is separated so as to allow unfrozen articles to be fed between the freezer plates while a like number of frozen articles are simultaneously discharged therefrom through the freezer exit. The aforedescribed loading and unloading procedures are generally typical for most conventional types of plate freezers.

Heretofore in carrying out the aforenoted loading and unloading procedures, certain serious problems have been encountered, such as: added insulation values from pre-boxing; or tilting and/or defacing of numerous articles as they move between the adjacent spaced plates thereby causing spillage of the unfrozen contents thereof; or jamming of the articles between the freezer plates thereby causing certain of the articles to become permanently distorted by being crushed or compressed together. In addition to freezer plates being soiled by such spillage, controlled freezing of the contents is difficult to attain. The appearance of distorted articles might render same unmerchantable. It is such problems as well as others to be hereinafter discussed which are effectively avoided or overcome by the improved apparatus 10.

Mounted on framework F adjacent discharge section 14 and extending vertically therefrom is a first elevator unit 15. In a similar manner there is mounted on the framework F adjacent infeed section 13 and extending vertically therefrom, a second elevator unit 16. The upper end portions 15*a*, 16*a* of the respective units 15 and 16 terminate above the top of the freezer 11. The end portions are interconnected by an elongated horizontally extending guideway 17 which forms a part of framework F and overlies the exterior top surface of the freezer. The functions of the elevator units and guideway will be discussed more fully hereinafter.

The infeed section 13 of framework F includes an elongated first station S having a planar, horizontally disposed surface on which a group G of articles is positioned prior to being fed into the freezer through the entry E, see FIG. 3. Each group G consists of a predetermined number of articles which are arranged in a predetermined pattern (e.g., a single row). The length limitations of the row is dependent upon the width of the freezer entry and exit. The articles A comprising a group G should have substantially the same height so that when they are disposed between freezer plates they will all be in contact with both plates when the latter are adjusted to an article-contact freezing position. The height limitation of the articles is also dependent upon the height of the freezer entry and exit and the extent to which the freezer plates are separated during loading and unloading. The peripheral configurations of the articles of a group may vary widely or may be uniform. In the illustrated embodiment and for purposes of describing the invention, the articles of the group are of uniform size and shape and each article includes a rectangular tray formed from a sheet of thin gauge metal or similar material. It should be noted, however, that the articles might be packaged in paperboard cartons or trays or wrapped in paper, plastic or foil. Thus, the invention is not intended to be limited to a single type of article.

The tray, as seen in FIG. 5, is of a conventional design and includes a substantially flat bottom $T_1$ and upwardly extending, divergent side and end walls $T_2$ which terminate in an outwardly extending ledge $T_3$ defining an open top. The articles of a group when disposed at the station S are arranged in a single row with the articles thereof in abutting side by side relation.

Prior to being positioned at station S, the articles A are assembled at a staging area 18 formed at one end of a suitable conveyor; the latter being of a type which utilizes a low coefficient of friction to handle articles with no incidence of misalignment. One such conveyor utilizes rollers on close centers in which individual rollers are rotatably mounted on shafts, some of which may be powered as necessary to move the articles into a sequenced line at the infeed station. One presently available commercial example of such a conveyor is sold by Shuttleworth Inc. of Huntington, Indiana under the name "Shuttleworth Slip-Torque". By the time the articles reach the staging area 18 a portioned quantity or serving of the food item, or items, has been deposited into the tray and either a cover has been placed over the open top of the tray or the top left uncovered.

The staging area 18 and station S are substantially coextensive and are arranged in side by side, parallel, coplanar relation.

The planes of the staging area 18, the article-supporting surface of station S, and the article-supporting surface of plate 12 of the pair of freezer plates aligned at the freezer entry are preferably in coplanar relation; thereby facilitating movement of the articles from the staging area onto the plate (12) surface. As seen in FIG. 3, the lower edge $E_1$ of the freezer entry is preferably recessed from the plane of station S.

When the required number of articles A to form a group G has assembled on the staging area 18, all of the assembled articles are simultaneously moved in a time sequence by a first pusher unit 20, see FIGS. 2–5. The unit 20 includes a pair of horizontally disposed racks 21 which are arranged in spaced parallel relation and mounted on the framework F so as to move in unison in a horizontal plane disposed above the staging area 18 and station S but below the top $E_2$ of the freezer entry E.

The racks 21 are in meshing engagement with a pair of drive gears 22, **22*a* interconnected to one another by a transversely extending horizontally disposed drive shaft 23. The shaft is rotatably supported by bearings 24 carried on the framework F. One end of shaft 23 is connected to a reversible motor M (e.g., a hydraulically driven orbital type) mounted on the framework F. Depending upon the direction of rotation of gears 22, 22*a* the racks 21** will simultaneously move in a direction towards the freezer entry (referred to as the operative mode) or away from the freezer entry (referred to as the inoperative mode).

Pivotally mounted on each rack 21 is a pair of longitudinally spaced pusher arms **25*a*, 25*b*, see FIG. 3. Corresponding arms on the racks have the distal ends thereof interconnected by an elongated, transversely extending bar 26*a*, 26*b*. Bar 26*a* and associated arms 25*a* are disposed closest to the freezer entry E, see FIG. 3. Each bar has a length equal to at least the extent of the article row forming the group G. The corresponding arms attached to a bar are also interconnected by an elongated axle piece 27*a* or 27*b*** which forms the pivotal axis for the connected arms, see FIG. 2.

Each rack 21 is supported by an elongated track 28 affixed to the framework F. The racks 21 are maintained in proper spaced, parallel relation by one or more bracing members 30. Projecting from the underside of each track 28 in a direction towards the other track is a pair of spaced, axially aligned cam members **31*a*, 31*b*. Each cam member of a pair is adapted to be slidably engaged by a trip block 32, one being disposed adjacent each arm 25*a*, 25*b*. Corresponding trip blocks 32 are pivotally mounted on the respective axle piece 27*a*, 27*b*** for independent movement relative to the adjacent arm.

When the pusher assembly 20 is in an operative mode, as seen in FIG. 3, one group of articles is being fed from station S through entry E onto freezer plate (12) surface by corresponding arms **25*a* and bar 26*a* while at the same time a second group of articles is simultaneously being moved by corresponding arms 25*b* and bar 26*b* from the staging area 18 onto station S. The length of the operative mode stroke is such that arms 25*a* and bar 26*a* will project into the freezer a sufficient amount so that the group of articles and encompassing frame element engaged thereby will clear the freezer entry E. The rack 21, arms 25*a* and bar 26*a*** at the forwardmost end of the operative mode stroke are shown in phantom lines in FIG. 3.

When the first pusher unit 20 is in an operative mode, the arms **25*a*, 25*b* of each rack assumes a substantially vertical position, see FIG. 4. A suitable stop, not shown, maintains the arms in substantially vertical depending positions relative to the corresponding axle piece when the pusher assembly is moving in its operative mode stroke. It will be noted in FIG. 4 that a depending, offset finger 32*a* is formed on each trip block 32 and extends angularly rearwardly from axle piece 27*a*, 27*b* and pusher arm 25*a*, 25*b* and slidably engages the upper surface of the corresponding cam member 31*a*, 31*b*. When, however, the rack nears the end of its operative mode stroke, the trip block finger 32*a* clears the end of the cam member 31*a*, 31*b*. In addition to the force of gravity, the finger is spring biased to assume a substantially vertical depending position, e.g., by a torsion spring around the shaft 27 and connected between the respective finger 32 and arm 25**.

Upon the rack reaching the end of its operative mode stroke, the motor M will automatically reverse its direction of rotation thereby causing the rack and its associated pusher arms and trip blocks to move as a unit in the opposite direction away from the freezer entry E. Movement in such a direction constitutes the inoperative mode stroke. After moving a short distance in its inoperative mode stroke, each of the trip block finger **32*a* will engage the end of the corresponding cam member whereupon the block will be pivoted in clockwise direction by the cam member. As the block pivots in the clockwise direction, a laterally extending portion L of the finger will engage the back side of the adjacent pusher arm causing the latter to also pivot in a clockwise direction raising the bar 26*a*, 26*b* connected to the distal ends of corresponding pusher arms a sufficient amount so as to clear the groups of articles positioned at station S and the staging area 18. Once the groups of articles have been cleared by the bars 26*a*, 26*b*, the trip block fingers 32*a*** will become disengaged from the respective cam members and will automatically resume substantially vertical depending positions. This latter movement occurs just prior to racks reaching the end of the inoperative mode stroke. Thus, the rack arms, bars and trip blocks will be in their proper positions for the commencement of the operative mode stroke. It should be noted that each pusher arm is capable of pivoting through a quadrant defined by radii disposed at approximately 180° and 270°.

The surfaces of bars 26a, 26b, which simultaneously engage the articles of the groups at the station S and staging area 18 during the operative mode stroke, are preferably flat and disposed substantially normal to direction of travel of the racks 21. By reason of this surface configuration and disposition, the individual articles of a group will slide along the supporting horizontal surfaces without tipping or tilting. Furthermore, by reason of the articles being disposed in a predetermined pattern (e.g., a single row) the article when engaged by the bar 26a, 26b will not, in turn, abuttingly engage another row of articles positioned ahead of it.

Figure 2:
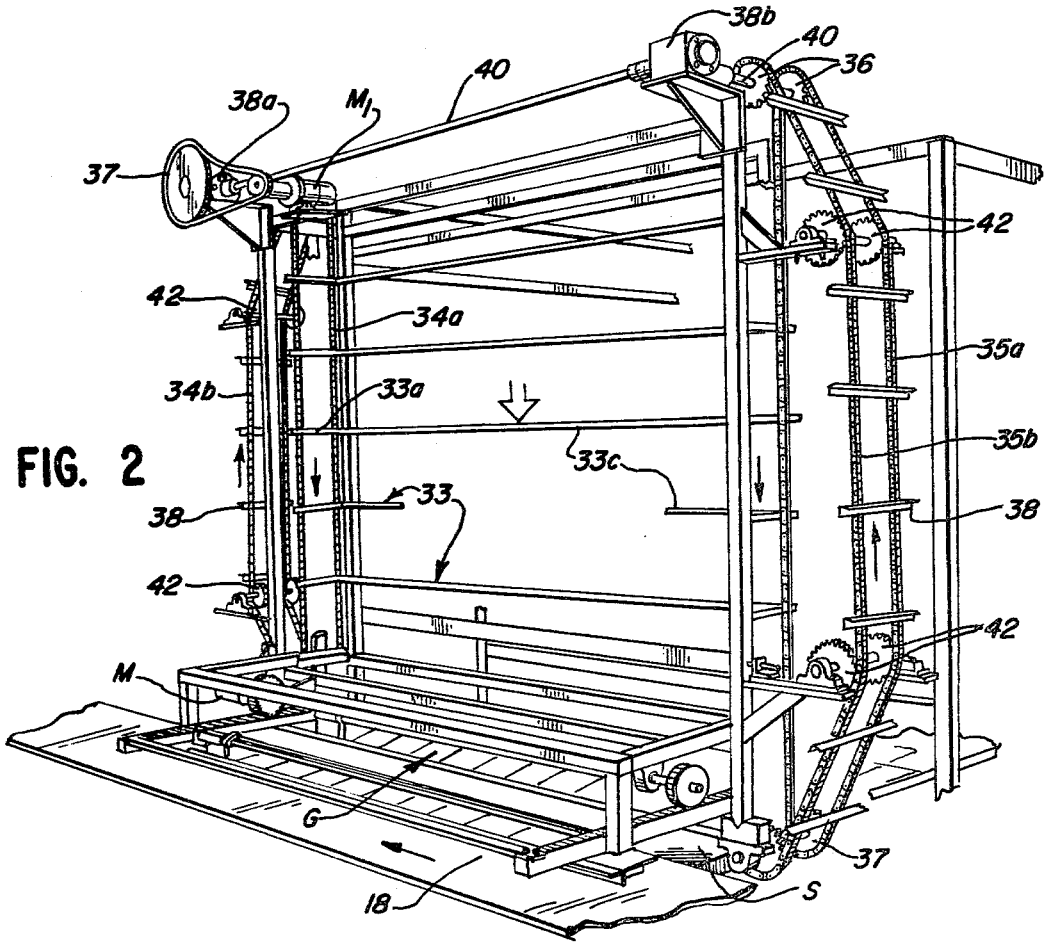
FIG. 2 is a fragmentary perspective view of the infeed section of the apparatus of FIG. 1.
Figure 7:
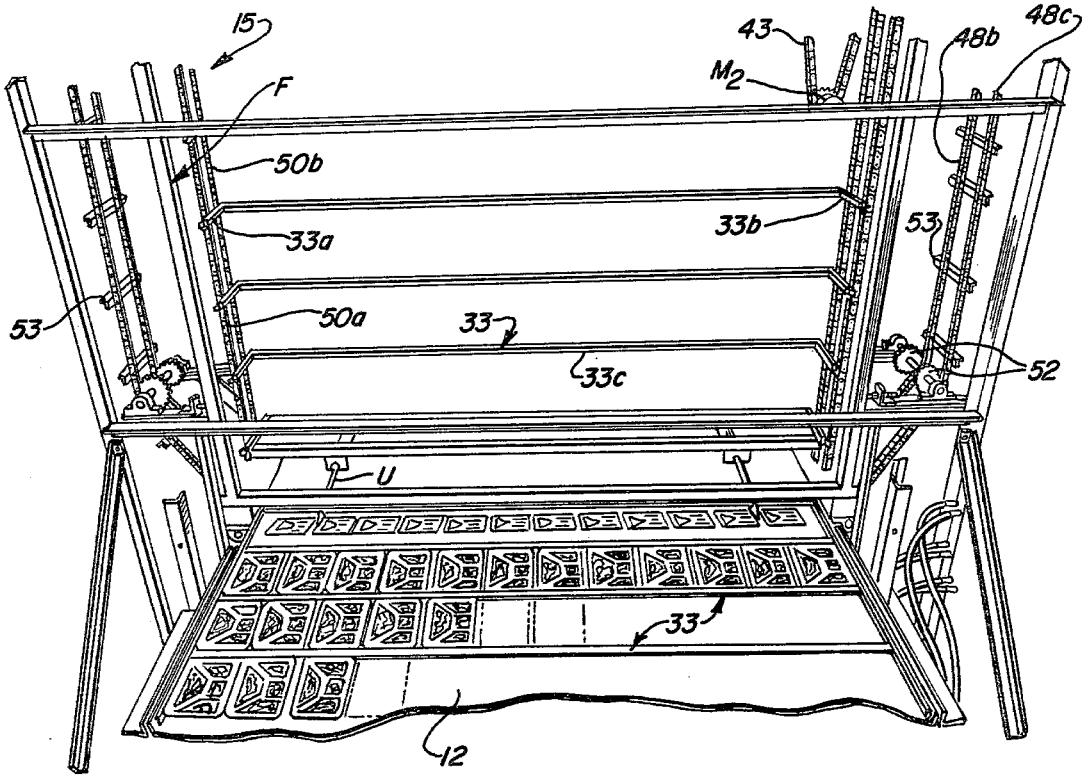
FIG. 7 is a fragmentary perspective view of the discharge section of the apparatus framework of FIG. 1 and with various assembled frame elements and groups of articles shown disposed on the supporting freezer plate as they approach the discharge section.

Upon a group of articles being disposed at station S and prior to same being engaged by the bar 26a connected to the corresponding pusher arms 25a, the group is substantially encompassed (e.g., closed on at least three sides) by a frame element 33 which has previously been carried above station S by the second elevator unit 16, see FIGS. 1 and 2.

In the illustrated embodiment each frame element 33 is of like construction and has a substantially C-shaped configuration with relatively short, straight leg segments 33a, 33b having corresponding ends thereof interconnected by an elongated center segment 33c. The length of center segment 33c should be greater than the length of the row of articles comprising the group. The leg segments 33a, 33b are disposed at opposite ends of the encompassed row of articles. Each of the leg segments is of a length so that when a group of articles is encompassed by the frame element, the leading peripheral segments of the articles will not contact the center segment 33c of the frame element. As the row of articles and associated frame element are slidably moved as a unit from station S through the freezer entry E by the bar 26a during the operative mode stroke, the free trailing ends of the leg segments 33a, 33b will be engaged by the bar 26a attached to the depending arms 25a of pusher assembly 20.

Each frame element is preferably formed of a rigid, light weight, metallic material which is capable of withstanding substantial temperature variations without becoming distorted or fractured when subjected to substantial load-bearing forces during certain phases of the loading, freezing, and unloading operations. Furthermore, the frame element when in assembled relation with a group of articles may be greater than, the same as, or slightly less than the height of the articles being frozen, depending upon the nature of the articles or product being frozen and the type of freezing operation desired. In many instances the frame will not extend upwardly above the top surface of the articles so that when the adjacent freezer plates are adjusted to freezing positions, the top and bottom surfaces of the articles will be in surface contact with both plates. The height of the frame element, however, should be such that the element will act as a spacer between adjacent freezer plates and thereby prevent the articles disposed therebetween being subjected to an excessive amount of compressive force and thus permanently severely distort the geometry of the articles. In other instances the frame elements may be of sufficient height to maintain the upper plate above the article to avoid pressure from the upper freezer plate crushing the article, such as in the instance of a pie with a top crust or topping.

The elevator unit 16 includes two sets of chains 34, 35, see FIG. 1. The sets of chains are of like construction and each chain 34a, 34b or 35a, 35b of a set is engaged by vertically spaced sprocket wheels 36, 37. Corresponding portions of the chains of a set are interconnected by transversely extending, horizontally disposed flights 38. Corresponding flights of the two sets of chains supportingly engage the underside of the leg segments 33a, 33b of the frame element 33.

In the illustrated embodiment, a plurality of vertically spaced frame elements are held in elevated positions above station S and are successively lowered by the elevator unit 16 in a timed sequence with respect to the movement of pusher unit 20 so as to encompass a group of articles previously deposited at station S. When the frame element is assembled with a group G, the center segment 33c will be disposed forwardly of the encompassed group and the leg segments 33a, 33b extending rearwardly at opposite ends of the group.

As seen in FIG. 2, the upper sprocket wheels 36 for both sets of chains 34a, 34b and 35a, 35b are driven by a single motor $M_1$ which is mounted on the framework F at the upper end of the infeed section. The rotational output of motor $M_1$ is transferred to the sprocket wheels 36 through an auxiliary chain-sprocket assembly 37, gear boxes 38a, 38b, an elongated shaft 40 interconnecting the boxes 38a, 38b and drive shafts 41 extending from the boxes to the sprocket wheels 36. Suitable idler sprockets 42 are provided on the infeed section to provide the necessary tension and guidance for the sets of chains.

A similar arrangement for driving the elevator unit 15 is provided at the discharge section of the framework. The unit 15, as seen in FIG. 6, includes a motor $M_2$ mounted on the upper part of the discharge section; an auxiliary chain-sprocket assembly 43 connected to the motor drive shaft; gear boxes 44a, 44b; an elongated shaft 45 interconnecting the gear boxes; and drive shafts 46 extending from the boxes to the upper pair of sprocket wheels 47, the latter being the drive wheels for the sets of chains 48a, 48b and 50a, 50b comprising the elevator unit 15. As in the case of elevator 16, there are lower sprocket wheels 51 for the sets of chains which are vertically aligned with respect to the upper sprocket wheels 47. Intermediate sprocket wheels 47 and 51 are various idler wheels 52.

It should be noted the axes of the upper sprocket wheels 47 defined by the shafts 46 extending from the gear boxes 44a, 44b are elevated relative to the guideway 17. This relationship is important so that the frame elements 33, which have been separated from the groups of articles at the discharge section, will be properly positioned so that they can be successively moved off of the flights 53 provided on the sets of chains onto the guideway by a pusher assembly 54 located adjacent the top of the elevator 15.

Figure 8:
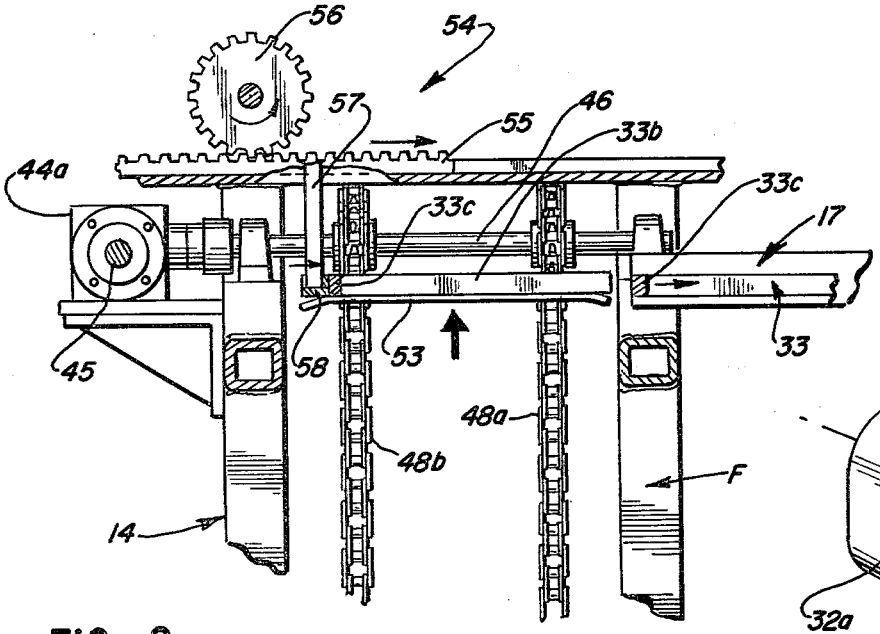
FIG. 8 is an enlarged fragmentary vertical sectional view of a second pusher assembly which is adapted to successively move frame elements from a second station elevated above the discharge section of the apparatus along a horizontal guideway during return of the frame elements to the station of the framework infeed section.
Figure 9:
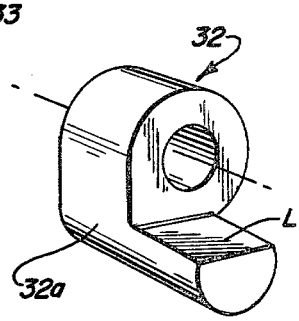
FIG. 9 is an enlarged perspective view of a trip block which is a component of the first pusher assembly shown in FIGS. 4 and 5.

Pusher assembly 54 is seen more clearly in FIG. 8 and includes a pair of elongated racks 55, drive gears 56 (one for each rack), an arm 57 depending from each rack, and an elongated transversely extending bar 58 interconnecting the lower ends of the depending arms 57. A suitable reversible motor $M_3$ is mounted on the framework F and provides the rotational driving force for the drive gears 56. The motor $M_3$ is preferably the same as the motor M utilized in connection with the assembly 20 disposed at the infeed section of the framework.

The racks 55 are slidably supported by the framework so they will move in a common horizontal plane which is disposed above the plane of travel of the frame elements while the latter are moving within the guideway 17. The bar 58, however, as noted in FIG. 8 is adapted to move in the same plane as that of the guideway.

The actuation of motor $M_3$ is in timed sequence with that of the motor $M_2$ which drives elevator unit 15. The movement of the elevator flights 53 is intermittent and suitable controls, not shown, are provided to insure that the flights engaging a separated frame element will come to rest at a first elevated station which is in the plane of the guideway 17. Controls for such purposes, as well as sequencing the operation of the various other motors M and $M_1$ are well known in the art. Such sequencing of these motors can be coordinated with controls provided on the plate freezer by use of a programmable controller, not shown, but well understood in the art.

As noted in FIG. 1, when the frame elements are moving along the guideway 17 they are in abutting relation with each other and the center segment 33*c* of each frame element assumes a trailing position during this portion of its travel. When the frame elements reach the end of the guideway adjacent the lowering elevator unit 16, each frame element will automatically move between the spaced sets of chains 33*a*, 33*b* and 34*a*, 34*b* and be supportingly engaged by a pair of flights 38 which had previously come to rest at a second elevated position which is coplanar with the plane of movement of the frame elements across the guideway 17. Once a frame element from the guideway has been accommodated by a pair of flights at the second elevated station, the flights move downwardly a predetermined amount until the succeeding pair of flights comes to rest at the second elevated station. The downward movement of a frame element is delayed until the pusher assembly 20 has been actuated so as to position a group of articles at station S.

Suitable safety devices, not shown, are provided so as to assure that the group G of articles at station S are encompassed by a frame element before being moved through the freezer entry E.

As aforementioned, when the group of articles and the encompassing frame element move from the plate (12) surface past the freezer exit, the group and frame element become separated from one another. The separation is automatically accomplished by reason of a downwardly inclined ramp R which extends from the freezer exit and onto which the group of articles drop and slide due to the forces of gravity acting upon each article of the group. At the lower end of the ramp the frozen articles move onto a conveyor or table, not shown, and may be subsequently packed in bulk shipping containers, not shown.

Simultaneous with the group of articles dropping onto the ramp R, the frame element moves onto guides U mounted on the framework F and disposed in coplanar relation with the surface of the plate 12 on which the group of articles and the frame element had just moved across. The plane of guides U and the plane of the ramp R are in divergent relation with respect to one another as they extend outwardly from the freezer exit.

Because of the fact that the articles comprising a group G do not abut a preceeding group of articles as they move from station S across plate 12 and to the discharge section 14 of the framework, the possibility of the articles of one group sliding over or being tilted by the articles of the other group is eliminated. The need for pre-boxing is avoided, thereby enhancing the freezing efficiency and permitting the user to box the product after freezing, if desired, without risk of spillage during boxing. With some articles boxing may be eliminated completely. Thus problems which previously existed with plate freezers and the like have been readily overcome. Furthermore, with the improved apparatus, a variety of odd-shaped articles can be readily and simultaneously handled by the apparatus and the conventional plate freezer. Such articles may be prepackaged, semi-packaged or contain a variety of products, or may be nonprepackaged articles, and may or may not require contact with both the upper and lower freezer plates simultaneously.

It will be appreciated that apparatus has been provided which meets the aforestated objects.

The shape, size and relative positioning of the various components comprising the improved apparatus may be varied from that shown and will depend in large measure on the type of articles to be handled and the size and capacity of the freezer being utilized. Furthermore, the types and number of motors utilized to effect actuation of certain of the components can also be varied from that illustrated in the drawings.

What is claimed is:

1. An apparatus for use in combination with a supporting surface for handling a plurality of articles segregated into groups, each group having the articles thereof arranged in a predetermined pattern, said apparatus comprising a framework having an infeed section and a discharge section, said sections being adapted to be disposed respectively adjacent spaced first and second peripheral segments of the surface; a plurality of frame elements movably carried on said framework; first means movably mounted on said framework for successively positioning groups of articles at a station provided on said infeed section; second means movably mounted on said framework and operable in timed sequence with said first means for positioning a frame element in substantially encompassing relation with a group of articles disposed at said station; third means movably mounted on said framework and operable in timed sequence with said second means for simultaneously moving a group of articles and encompassing frame element from said station, across said surface and to said discharge section; fourth means mounted on said framework for effecting separation at said discharge section of a group of articles from an encompassing frame element; and fifth means movably mounted on said framework and coacting with said second means for returning a separated frame element to said station and encompassing another group of articles.

2. The apparatus of claim 1 wherein said infeed and discharge sections are in horizontally spaced relation, and said stations are adapted to be in substantially coplanar relation with the surface.

3. The apparatus of claim 1 wherein each frame element includes an elongated first portion for disposition adjacent one side of the group encompassed by said frame element, and a second portion extending angularly from said first portion for disposition adjacent a second side of the encompassed group, said frame element first portion being angularly disposed relative to the direction of movement of the frame element and encompassed group of articles from said station to the discharge section.

4. The apparatus of claim 3 wherein the first portion of each frame element is disposed forwardly of the group of articles encompassed thereby, and the second portion extends angularly rearwardly of the first portion; said frame element when being moved across the surface having the first portion thereof abutting a trailing end of the second portion of a next preceeding frame element being moved across the surface.

5. The apparatus of claim 4 wherein the first portion of a frame element is adapted to simultaneously abut a corresponding peripheral segment of each article comprising the next preceeding encompassed group of articles on the surface.

6. The apparatus of claim 3 wherein said frame elements are of like construction and each element has an elongated first portion which is adapted to be at least substantially coextensive with the row of articles of a group, and a pair of second portions having corresponding ends thereof interconnected by said first portion, said second portions extending angularly rearwardly from said first portion and adapted to be disposed at opposite ends of a group of articles when said frame element is encompassing the group.

7. The apparatus of claim 6 wherein the first and second portions of a frame element define a substantially C configuration and said second portions are in spaced substantially parallel relation.

8. The apparatus of claim 7 wherein the open side of each C-shaped frame element faces rearwardly as said frame element is being moved from the infeed section across the surface to the discharge section.

9. The apparatus of claim 8 wherein the open side of a C-shaped frame element is closed by the first portion of a succeeding frame element as said frame elements are being moved from the infeed section across the surface to the discharge section.

10. The apparatus of claim 9 wherein the second portions of each frame element are in substantial alignment with the direction of movement of the frame element by said third means and the first portion of each frame element is disposed substantially transverse to said direction of movement.

11. The apparatus of claim 1 wherein the third means effects intermittent movement of a group of articles and encompassing frame element from said station, across the surface and to said discharge section.

12. The apparatus of claim 1 wherein the fourth means includes a ramp adapted to extend from the second peripheral segment of the surface and over which a group of articles is adapted to move upon leaving the surface, said ramp defining a first plane; and a guide adapted to be disposed adjacent to and extending from the second peripheral segment of the surface and onto which a frame element moves upon leaving the surface, said guide defining a second plane; said planes being adapted to extend divergently outwardly from the second peripheral segment of the surface.

13. The apparatus of claim 12 wherein the fifth means includes a power driven elevator mounted on said framework and disposed adjacent said discharge section and coacting with said guide to lift each separated frame element therefrom to a first elevated station in proximity to said discharge section; an elongated guideway mounted on said framework and extending from said first elevated station to a second elevated station in proximity to said infeed section; a pusher unit adjustably mounted on said framework and disposed adjacent said first elevated station and operable in timed relation with said elevator for moving each lifted frame element from said first elevated station onto said guideway and effect sliding movement of the frame element therealong to said second elevated station; said second elevated station being disposed adjacent said first means whereby the latter is adapted to lower a frame element from said second elevated station into an encompassing position with another group of articles disposed at the station adjacent said infeed section.

14. The apparatus of claim 13 wherein the elevator includes a plurality of flights disposed adjacent opposite sides of the guide; corresponding flights engaging opposite ends of each frame element while the latter is being lifted to said first elevated station.

15. The system of claim 13 wherein the first means includes a second elevator mounted on said framework and extending from said second elevated station to the station of said infeed section, said second elevator being provided with a plurality of opposed flights moving past said second elevated station, corresponding flights engaging the second portions of each frame element while the latter is disposed at said second elevated station and being adapted to lower the engaged frame element into an encompassing relation with a group of articles positioned at the station of said infeed section.

16. The apparatus of claim 15 wherein the elevators adjacent the infeed and discharge sections operate in substantially parallel vertical planes when the flights thereof are engaging frame elements.

* * * * *